United States Patent [19]

Bachle et al.

[11] 3,966,364

[45] June 29, 1976

[54] PISTON PUMP

[75] Inventors: Wilfred H. Bachle, Long Beach; John V. Peck, Anaheim; Thomas D. Stantial, Carpinteria; Richard H. Williams, Corona del Mar, all of Calif.

[73] Assignee: Oxy Metal Industries (Intra) Inc., Warren, Mich.

[22] Filed: Dec. 24, 1974

[21] Appl. No.: 536,232

[52] U.S. Cl. ..... 417/539; 417/540; 92/58.1

[51] Int. Cl.[2] ..... F04B 25/04

[58] Field of Search ..... 417/521–531, 417/539, 903, 571, 540; 92/68, 58.1

[56] References Cited

UNITED STATES PATENTS

| | | | |
|---|---|---|---|
| 202,821 | 4/1878 | Hoffman | 92/68 |
| 439,992 | 11/1890 | Anderson | 417/903 |
| 1,328,529 | 1/1920 | Lillos | 417/903 |
| 1,400,422 | 12/1921 | Curtis | 417/454 |
| 1,447,669 | 3/1923 | Landin | 92/58.1 |
| 1,915,827 | 6/1933 | Kickler | 417/521 |
| 3,253,518 | 5/1966 | Dopmler | 92/68 |
| 3,282,224 | 11/1966 | Bock et al. | 417/539 |
| 3,410,477 | 11/1968 | Hartley | 417/571 |
| 3,730,651 | 5/1973 | Ellis | 417/903 |

FOREIGN PATENTS OR APPLICATIONS

| | | | |
|---|---|---|---|
| 757,184 | 12/1933 | France | 417/539 |
| 999,477 | 1/1952 | France | 417/539 |
| 293,321 | 10/1929 | Italy | 417/539 |

*Primary Examiner*—William L. Freeh
*Attorney, Agent, or Firm*—Harris, Kern, Wallen & Tinsley

[57] ABSTRACT

A single acting dual piston positive displacement pump with alternating piston motion. A pump suitable for manual operation and operable at relatively high pressure such as 400 to 800 psig. A pump suitable for pumping corrosive liquids with the drive mechanism separated from the liquid lines. A pump housing with cylinder section and abutting manifold section, with the alternating reciprocating pistons in the cylinder section and the inlet and outlet openings in the manifold section, with the pistons projecting from the cylinder section opposite the inlet and outlet openings for connection to the piston drive mechanism.

1 Claim, 6 Drawing Figures

PISTON PUMP

BACKGROUND OF THE INVENTION

This invention relates to pumps and in particular, to a new and improved single acting dual piston positive displacement pump suitable for manual operation and suitable for use in portable equipment such as a water purification unit.

A compact lightweight water purifier has been developed for use by hikers who must obtain their water from the land over which they travel. The purifier utilizes a reverse osmosis module which converts brackish water or sea water to potable water. Such a purifier requres a pump which should operate at relatively high pressure, typically in the range of 400 to 1000 psig, and be suitable for manual operation, and be resistant to the corrosive saline water to which it is exposed. The pump should also be of a size and configuration suitable for incorporation into and use with the portable purifier.

A pump with a rack and pinion gear drive, with the rack gear formed integrally with the piston was developed for use with the purifier, but was not satisfactory. There was excessive wear in the moving parts and substantial corrosion during use. Also, the pump was difficult and tiring to the operator.

It is an object of the present invention to provide a new and improved pump which overcomes the disadvantages of the prior art pump. A further object of the invention is to provide such a pump which is suitable for manual operation as well as for motor driven operation, and one which provides a maximization of pumping forces with a minimization of reactive forces and operator fatigue. A further object is to provide such a pump wherein cylinders, valving and manifold may be directly interconnected within the pump housing thereby eliminating interconnecting tubing and fittings. It is a particular object of the invention to provide such a pump wherein the piston drive mechanism may be separated from the fluid passages and wherein the pistons, cylinder housing and head or manifold may be made of an acetal plastic which has high corrosion resistance and low friction coefficient, as well as strength and dimensional stability in the water environment. One additional object is to provide such a pump which is suitable for applications in addition to water purifiers, in both portable and fixed configurations.

SUMMARY OF THE INVENTION

The pump in the preferred embodiment illustrated comprises a housing with pistons therein for parallel reciprocating motion, with the drive ends of the pistons extending from the housing. A rocker arm is mounted on the housing between the pistons and coupled to each of the pistons, with the rocking motion of the rocker arm providing the reciprocating motion for the pistons. The rocker arm may be manually driven or motor driven as desired. A manifold or pump head is provided at the opposite end of the pump housing and incorporates the inlet and outlet openings and the inlet and outlet check valves. The housing preferably is made in two abutting sections, one being the cylinder section carrying the pistons and the other being the head or manifold section carrying the inlet and outlet openings and interconnecting passages. The check valves may be dropped into recesses provided in the cylinder section, with the head section holding the check valves in place.

An accumulator may be attached to the housing adjacent the inlet and outlet openings while maintaining the preferred cylindrical configuration which readily permits the pump to be positioned in a casing which carries the water purification components or other elements as desired. The casing includes feet which may be folded outward in line with the rocker arm to form a base for the manual operation configuration.

DESCRIPTION OF THE PREFERRED EMBODIMENTS

Figure 1:
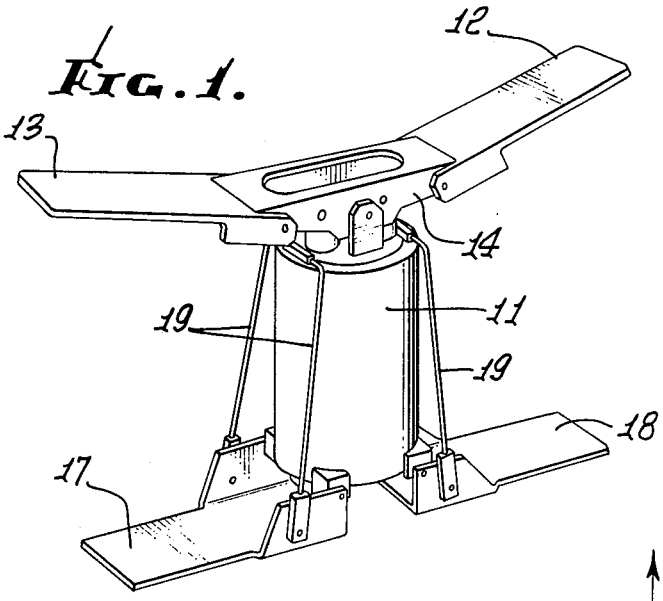
FIG. 1 is a perspective view of a water purifier incorporating the presently embodiment of the invention.
Figure 2:
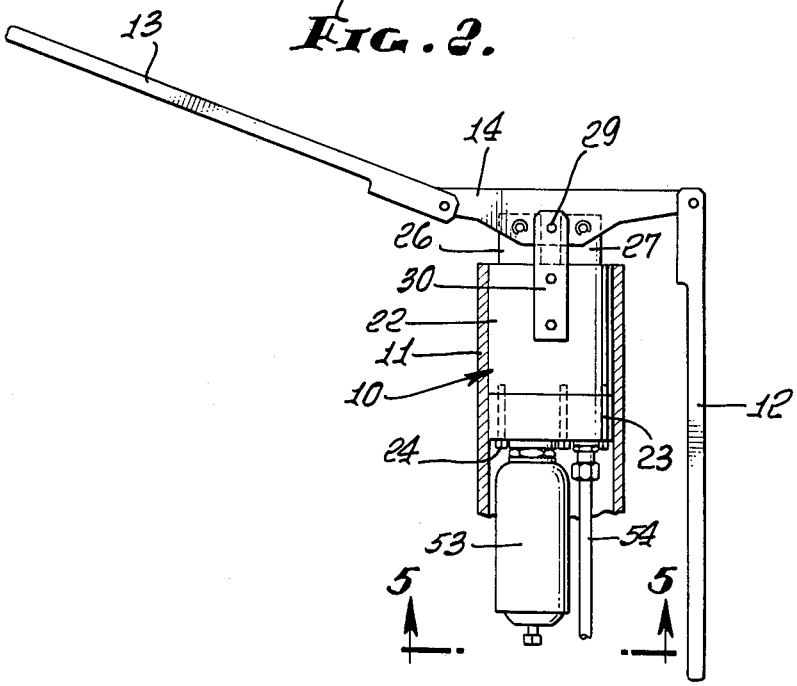
FIG. 2 is a side view of the pump of FIG. 1.
Figure 3:
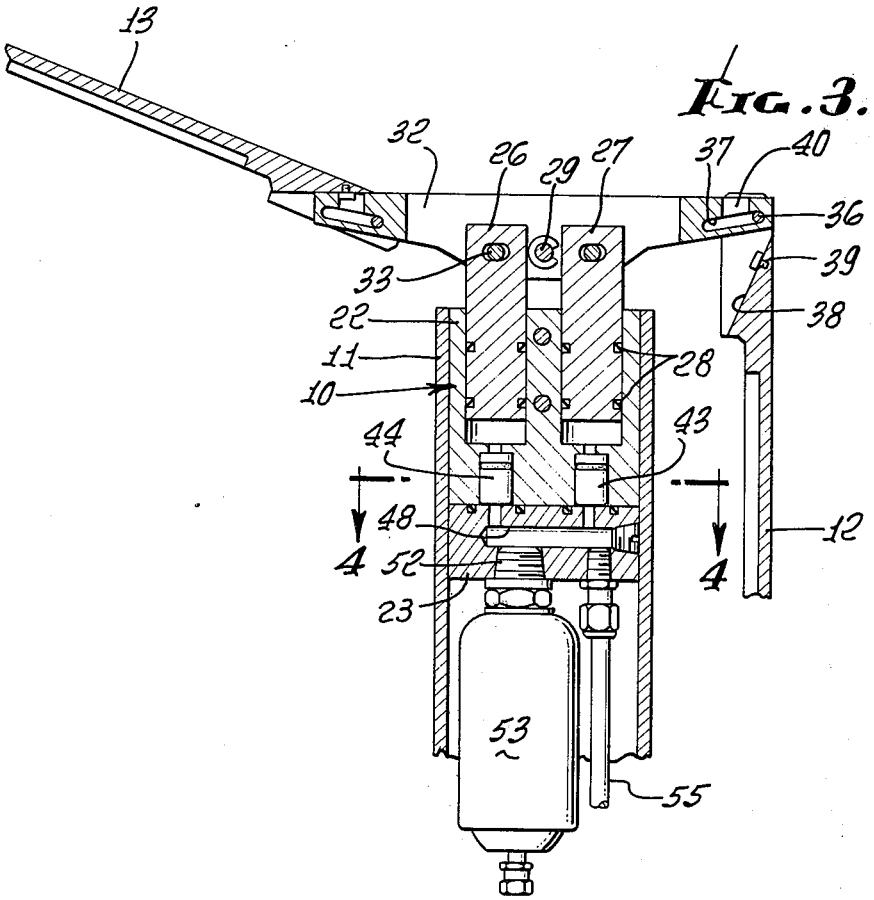
FIG. 3 is a partial sectional view through the pump of FIG. 2.
Figure 4:
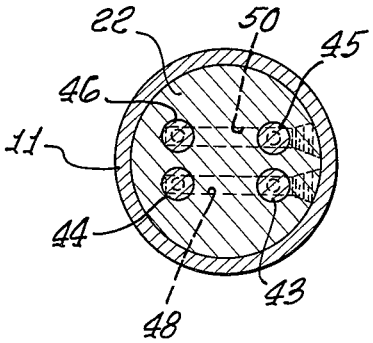
FIG. 4 is a sectional view taken along the line 4—4 of FIG. 3.
Figure 5:
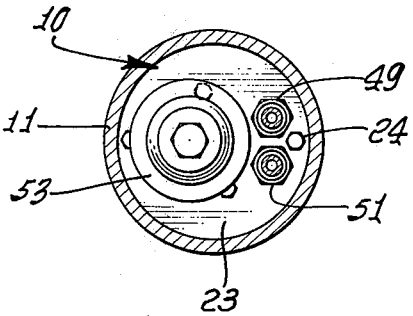
FIG. 5 is a bottom view of the pump of FIG. 2.

In FIG. 1, a pump 10 is mounted in a casing 11. The pump itself is cylindrical in configuration and slides within a plurality of donut shaped water purifier modules within the casing 11. Suitable lines for interconnecting a water source, the pump, the purification modules and a storage container are provided. The embodiment illustrated in FIG. 1 is designed for manual operation and includes handles 12, 13 carried as extensions of a rocker arm 14 at the upper end of the pump. Plates 17, 18, are pivotally mounted at the lower end of the casing 11 and swing outward from a vertical position adjacent the casing 11 to an extended position as shown in FIG. 1. The handles 12, 13 may fold down from the projecting position of FIG. 1, to a position adjacent the plates 17, 18, in the manner shown in FIGS. 2 and 3. Rods 19 may be pivoted at the upper end of the casing and fastened to the plates 17, 18 when in the projected position to rigidify the structure.

In operation, an operator may kneel with his knees on the plates 17, 18 and move the handles 12, 13 up and down by hand. Alternatively, the operator could sit or stoop with his feet on the plates 17, 18 and manually drive the handles 12, 13. When the pump is not in use, the rods 19 may be disconnected from the plates 17, 18, the plates folded upward and the handles 12, 13 folded downward to form a compact package suitable for carrying in a backpack or the like.

The pump 10 includes a housing with a cylinder section 22 and a manifold section 23, with the manifold section or head affixed to the cylinder section by bolts 24. Pistons 26, 27 are slidably positioned in openings in the housing section 22. An upper and a lower ring seal 28 is provided for each piston. The rocker arm 14 is carried on a pivot pin 29 supported by arms 30 affixed to each side of the housing section 22. The upper ends of the pistons 26, 27 project from the housing into a slot 32 in the rocker arm. Each piston is connected to the rocker arm by a pin 33 which rides in a lateral slot in the piston.

The handles 12, 13 may be moved between the stored position showed for the handle 12 and the extended position shown for the handle 13. Each handle carries a pin 36 which rides in a slot 37 in the rocker arm. When in the extended position, a surface 38 of the handle rests on the top surface of the rocker arm 14, with a screw hand 39 in an opening 40 of the rocker arm for positioning the handle.

Inlet check valves 43, 44 and outlet check valves 45, 46 are mounted in the lower end of the housing section 22. A lateral passage 48 in the manifold section 23 provides communication between an inlet opening 49 and the inlet check valves 43, 44. A similar passage 50 provides communication between an outlet opening 51 and the high pressure check valves 45, 46. Another outlet opening 52 may be provided connecting with the passage 50 for attaching an accumulator 53. An inlet line 54 may be connected at the inlet opening 49, and an outlet line 55 may be connected at the outlet opening 51.

In operation, the inlet line is connected to a source of liquid and the rocker arm 14 is oscillated to reciprocate the pistons in the housing. As a piston moves upward, the incoming liquid moves into the cylinder through the inlet check valve. As the piston moves downward, liquid is forced out of the cylinder at increased pressure through the outlet check valve. The accumulator 53 may be used on the outlet or high pressure line for the purpose of smoothing pressure surges.

Figure 6:
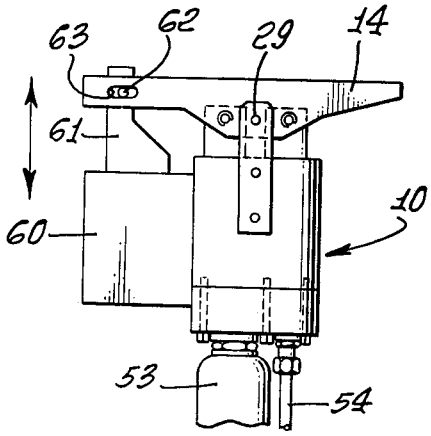
FIG. 6 is a partial view similar to that of FIG. 2 showing a motor drive configuration.

In an alternative embodiment shown in FIG. 6, a motor 60 may be mounted on the pump housing and coupled to the rocker arm 14 to provide a motor driven pump. The motor 60 may include a gear reduction unit 61 with an eccentric outlet shaft 62 riding in a slot 63 in the rocker arm 14.

In the preferred embodiment illustrated, the pistons 26, 27 and the housing sections 22, 23 are made of an acetal plastic providing both resistance to corrosion of salt water and low friction, as well as lightweight, strength and dimensional stability in a liquid environment. The rocker arm 14, handles 12, 13, and plates 17, 18 typically are of an aluminum alloy, anodized for corrosion resistance.

Pumps have been built as shown in the drawings and operate satisfactorily, providing an output of 0.15 gallons per minute at 600 psig with a pumping input of about 0.12 horsepower.

We claim:

1. In a single action positive displacement pump, the combination of:

a generally cylindrical pump housing having a cylinder section with first and second axially extending parallel piston openings extending through one end and an inlet and an outlet passage extending from each cylinder opening through the other end of said cylinder section, and a separate manifold section secured to said cylinder section with inlet and outlet openings communicating with said passages;

first and second pistons in the form of solid cylinders having drive ends and valve ends and slidably positioned in said first and second piston openings respectively, with said drive ends projecting out of said one end of said housing;

piston drive means including a rocker arm mounted on said housing between said projecting pistons and directly connected to said drive ends outside said housing;

a first inlet check valve and a first outlet check valve in corresponding passages in said cylinder section in communication with said first piston opening;

a second inlet check valve and a second outlet check valve in corresponding passages in said cylinder section in communication with said second piston opening;

inlet passage means in said manifold section connecting said inlet openings to said inlet check valves;

outlet passage means in said manifold section connecting said outlet openings to said outlet check valves;

means defining an accumulator chamber communicating with one of said passages in said manifold section; and outer housing means surrounding said cylinder section, manifold section and accumulator.

* * * * *